US006495763B1

(12) United States Patent
Eichmann et al.

(10) Patent No.: US 6,495,763 B1
(45) Date of Patent: Dec. 17, 2002

(54) SPECIFIC CABLE RATIO FOR HIGH FIDELITY AUDIO CABLES

(76) Inventors: Keith Louis Eichmann, 37 Varndell St., Bald Hills Brisbane 4036 (AU); Robert Bruce Woodland, 55 Lyndale Rd., Pullenvale Brisbane 4069 (AU)

( * ) Notice: Subject to any disclaimer, the term of this patent is extended or adjusted under 35 U.S.C. 154(b) by 0 days.

(21) Appl. No.: 09/890,308

(22) PCT Filed: Mar. 1, 2000

(86) PCT No.: PCT/AU00/00139

§ 371 (c)(1),
(2), (4) Date: Jul. 27, 2001

(87) PCT Pub. No.: WO00/77795

PCT Pub. Date: Dec. 21, 2000

(30) Foreign Application Priority Data

| | | |
|---|---|---|
| Jun. 9, 1999 | (AU) | PQ 0831 |
| Dec. 3, 1999 | (AU) | PQ 4413 |
| Feb. 4, 2000 | (AU) | PQ 5411 |

(51) Int. Cl.[7] ..... H01B 9/02
(52) U.S. Cl. ..... 174/113 R

(58) Field of Search ..... 174/113 R, 128.1, 174/128.2, 115, 116

(56) References Cited

U.S. PATENT DOCUMENTS

| | | | | |
|---|---|---|---|---|
| 4,628,151 A | * | 12/1986 | Cardas | 174/113 R |
| 5,428,189 A | * | 6/1995 | Dorner et al. | 174/115 |
| 6,194,663 B1 | * | 2/2001 | Friesen et al. | 174/110 R |

* cited by examiner

*Primary Examiner*—Chau N. Nguyen

(57) ABSTRACT

A signal carrying cable in which the return, negative or cold conductor is greater in overall cross sectional area and mass than the signal, positive or hot conductor, based on a specific ratio that balances the flow of electrons, enhances electron movement and as a result improves signal transmission. The ratio is based firstly on the cross sectional area of each signal core/s in relation to each return core/s, and secondly on the diameter or perimeter of each signal strand in relation to each return strand. The ratio works effectively whether there are one or more strands in each conductor. For cables where the diameter or perimeter of each strand is the same for both signal and return, the ratio is based on cross sectional area only. Cables can comprise conductor strands other than round i.e. square, flat, rectangular, tubular etc.

4 Claims, 5 Drawing Sheets

SPECIFIC CABLE RATIO FOR HIGH FIDELITY AUDIO CABLES

This invention relates to an improvement in the handling of reactance, improved electron flow balance, enhanced electron movement and subsequent improved performance in a signal carrying cable design to be used, for example, as an interconnect cable with phono or RCA type plug termination (connecting two pieces of electronic equipment such as CD or DVD player to pre-amplifier, pre-amplifier to amplifier etc) and loudspeaker cable (connecting amplifier to loudspeaker) for audio and home theatre applications. The invention is also effective for other cable applications such as data communication cables, microphone leads, patch cords and the like, video and digital cables, and any other signal carrying cables. Furthermore the invention can be used effectively for copper traces for circuit boards and in some signal carrying connecting hardware such as RCA type phono plugs and sockets, RF or coaxial connectors, and spade connectors wherever a signal and return conductor are involved.

As such, this invention has particular but not exclusive application to signal carrying cables, and for illustrative purpose reference will be made to such application.

Many signal carrying cable products are expensive, complex designs that are difficult to manufacture.

The complexity of the cable designs come about as designers seek to electrically optimize cables by reducing distortion and coloration to a minimal level. Two types of distortion that are recognized as being problematic are inductive reactance and capacitive reactance.

Variable current flow in a conductor generates inductance and capacitance as well as inductive reactance and capacitive reactance. Inductive reactance is directly proportional to frequency. So, when frequency increases, inductive reactance also increases. Capacitive reactance is inversely proportional to frequency. In other words, as frequency increases, capacitive reactance decreases.

In a signal carrying cable where the signal and return have the same strand number, strand size and mass, the overall inductive and capacitive reactance characteristics are increased (i.e. a doubling effect where reactance in the signal is combined with the reactance in the return) and as such the reactive resistance to each frequency is not balanced.

The present invention overcomes problems of reactance in signal carrying cables by speeding up the flow of electrons in the return conductor and balancing the reactive characteristics between signal and return. This is achieved by increasing the mass in the return conductor in relation to the mass of the signal conductor by using a specific ratio. When the mass of the return conductor is greater than the mass in the signal conductor the resistance of the return is significantly lower (than that of the signal) thereby providing a faster pathway for electrons to travel.

The return conductor is by its nature always responding to the signal conductor because it is constantly in delay mode. In the present invention the increased size and mass of the return conductor enables the return to respond more rapidly to the signal allowing an unimpeded and speedy flow of electrons.

By enhancing the flow of electrons in the cable, problems such as capacitive and inductive reactance appear to be diminished. A useful analogy is wind effect on a speeding bullet. The faster the bullet, the less influence wind has on its movement.

When using the ratio, the electron flow between signal and return conductors also appears more evenly balanced, with electrons at all frequencies travelling at the same apparent speed.

The ratio at the heart of the present invention is a ratio of firstly the cross sectional area of the signal core in relation to the return core, and secondly the diameter or perimeter of each electrically conductive strand in the signal in relation to the return, where the mass is intentionally increased in the return core.

The present invention relates to a cable with cores defined as the following:

1: A single strand within an insulated jacket hereinafter called "solid core".

2: A multi-strand core comprising non-insulated strands grouped together within an insulated jacket hereinafter called "multi-strand core".

3: Multiple strands individually insulated which may be grouped together within an insulated jacket hereinafter called "Litz style core".

4: Any of the above where the signal conductor core is shielded by a braided or foil shield as in a coaxial configuration, hereinafter called "shielded core".

The ratio of cross sectional area of the total signal core in relation to the total return core for solid cores, multi-strand cores and Litz-style cores is between 1:2.6 and 1:4.0 with the preferred ratio being 1:2.778.

When using a shielded core, the preferred ratio of cross sectional area of the total signal core in relation to the total return core is 1:3.56.

The increase in preferred ratio used for a shielded core (for example coaxial style 75 Ohm or 110 Ohm video or digital cable) appears to be due to a capacitive and/or inductive effect caused by an interaction between signal conductor and the surrounding shield, and return conductor and the shield.

The preferred ratio may also increase or decrease as a result of various shielding configurations, insulation types and metal conductors that may be used or the combination thereof. For example heavier shielding and/or change of impedance between signal conductor and shield may change the ratio. Similarly the use of high purity silver conductors may require a slightly different ratio to Oxygen free copper (OFC) conductors.

The ratio of stranding size of individual solid strand/s within the signal core in relation to individual solid strand/s within the return core of solid cores, multi-strand cores and Litz-style cores, and based on the diameter or perimeter of each strand, is 1:1.6 to 1:2.0, with the preferred ratio being 1:1.667. When using a shielded core, the preferred ratio is 1:1.887.

The preferred signal carrying cable design is one that uses the cross sectional area ratio and the diameter or perimeter ratio together.

For cables comprising multi-strand cores or Litz style cores and where the diameter or perimeter of each individual strand is the same for both signal and return, the ratio is based on the cross sectional area between the signal and return core and is between 1:2.6 to 1:4.0 with the preferred ratio being 1:2.778. When using a shielded core, the preferred ratio is 1:3.56.

Using the ratio with multi-strand cores or Litz style cores, the signal transmission appears to improve when the least number of strands are used. From our understanding of reactance this makes sense: less strands means that less reactance distortion effects are generated. Further, when using multi-strand cables, small diode or rectification effects arise from imperfect contact among the strands. Again, fewer strands are better.

Signal carrying cables can comprise conductor strands other than round i.e. square, flat, rectangular, tubular etc There are currently five types of geometry's utilized in signal carrying cables, the coaxial, the twisted pair, the woven, the helical pair and the parallel pair.

The present invention is preferably utilized in a parallel configuration where each conductive core needs to be laid beside each other and not twisted together.

Twisting of cores increases inductive and capacitive reactance in cables. However, where specific impedance is required i.e. 75 Ohm or 110 Ohm for digital and video use, then cores may be twisted to achieve the desired impedance.

To date, there has not been a signal carrying cable design that addresses and minimizes the effects of the above mentioned reactance problems by using a specific ratio as per the present invention. There is therefore a need for this invention.

In order that this invention may be more easily understood and put into practical effect, reference will now be made to the accompanying drawings which illustrate the embodiment of the invention using the ratio, wherein.

Figure 1:
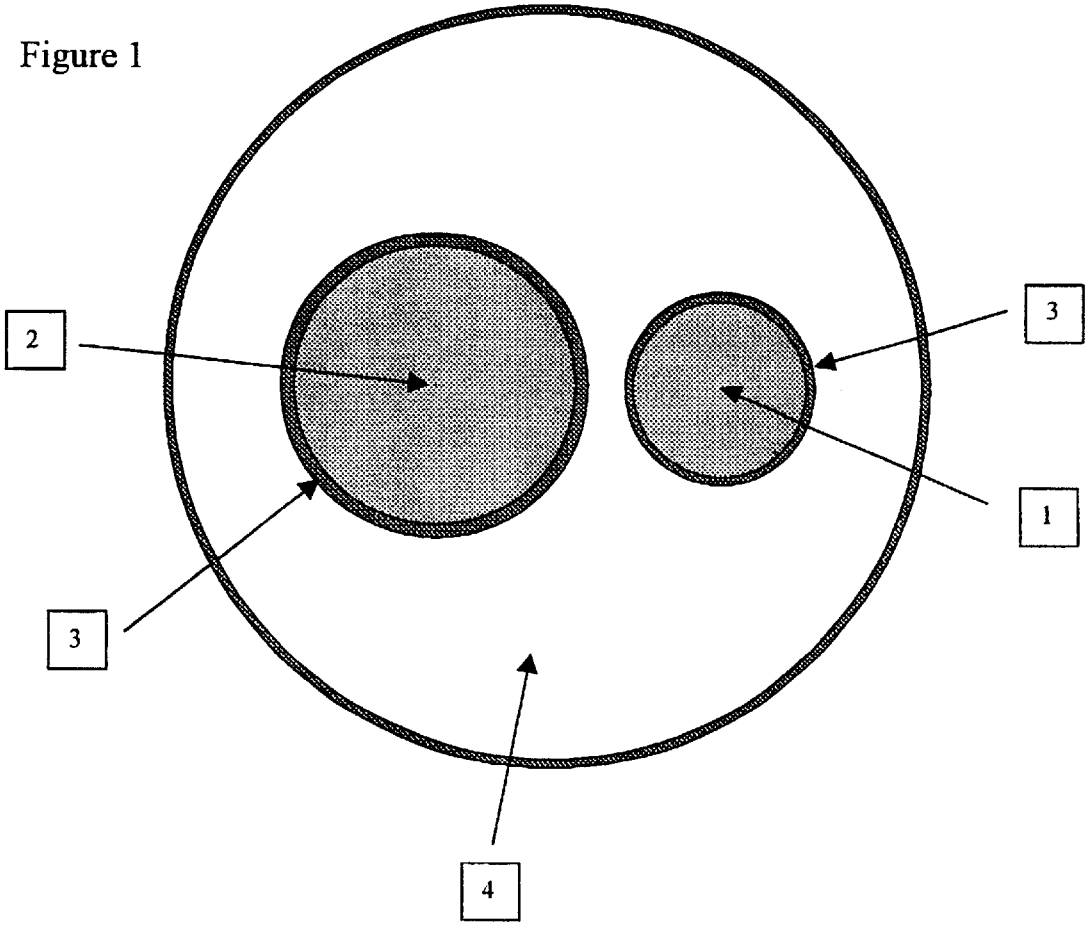
FIG. 1 is a cross-sectional end view of a signal carrying cable that is constructed in accordance with the present invention utilizing one solid core for both the signal and return conductors.

Referring to FIG. 1, which comprises one solid core for both the signal and return conductors, the parts shown are signal conductor 1, return conductor 2, conductor insulation material 3, and solid filler material 4.

Return conductor 2 has a greater cross-sectional area, diameter or perimeter and hence mass than signal conductor 1 based on the preferred cross-sectional area ratio of 1:2.778 and preferred diameter or perimeter ratio of 1:1.667.

Conductor insulation material 3 is preferably a low dielectric material such as polypropylene or Teflon while solid filler material 4 is preferably a soft, flexible PVC or equivalent material used to hold the cores in a parallel configuration.

Figure 2:
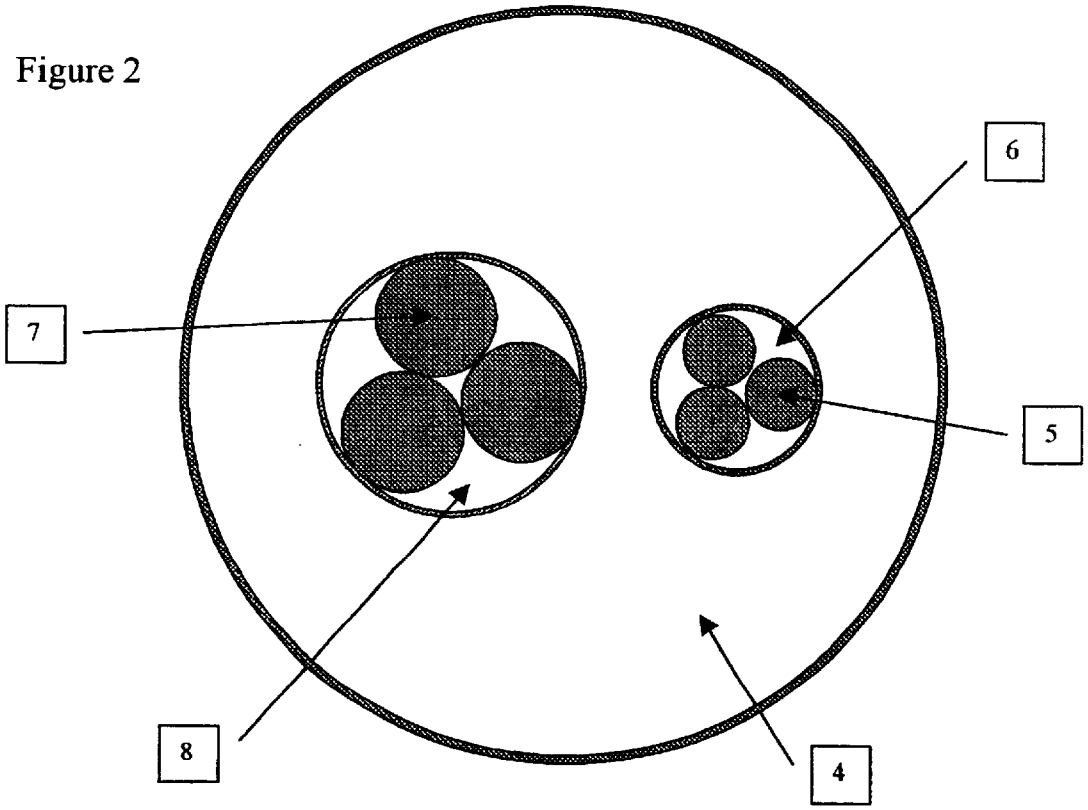
FIG. 2 is a cross-sectional end view of a signal carrying cable that is constructed in accordance with the present invention utilizing multi-strand conductors in both signal and return cores.

Referring to FIG. 2, which comprises multi-strand conductors in both signal and return cores, the parts shown are signal conductive strands 5, signal core 6, return conductive strands 7 and return core 8.

Return core 8 has a greater cross-sectional area (that is achieved by adding together the cross sectional areas of all three strands) than signal core 6 based on the preferred cross-sectional area ratio of 1:2.778. Each individual return conductive strand has a greater diameter or perimeter than each individual signal conductive strand based on the preferred diameter ratio of 1:1.667.

Figure 3:
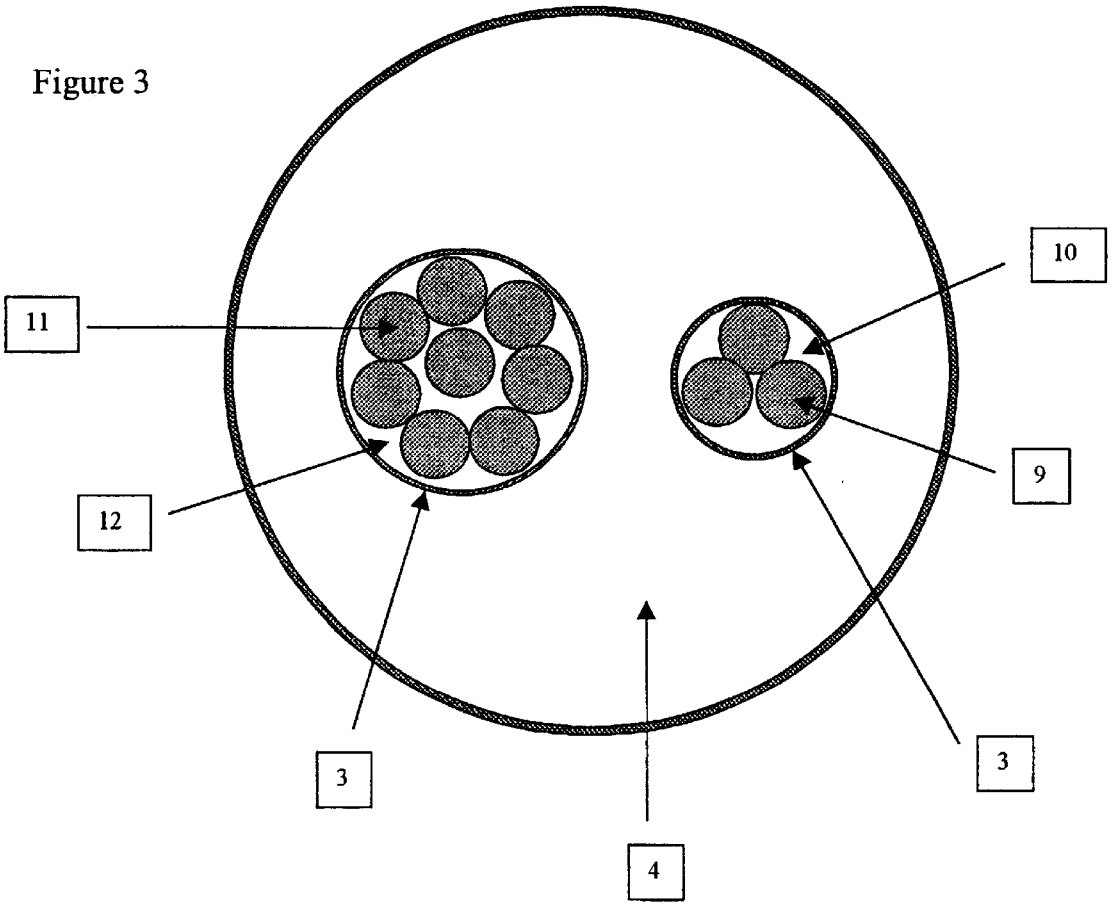
FIG. 3 is a cross-sectional end view of a signal carrying cable that is constructed in accordance with the present invention utilizing multi-strand conductors wherein each strand is of the same diameter or perimeter in both signal and return cores.

Referring to FIG. 3, which comprises multi-strand conductors in both signal and return cores wherein the diameter or perimeter of each individual strand in the signal and return cores is the same. The parts shown are signal strands 9, signal core 10, return strands 11 and return core 12.

When the diameter or perimeter of each strand in the signal and return cores are the same, then the return core 12 is greater in total cross-sectional area than the signal core 10 based on the preferred cross-sectional area ratio of 1:2.778.

Figure 4:
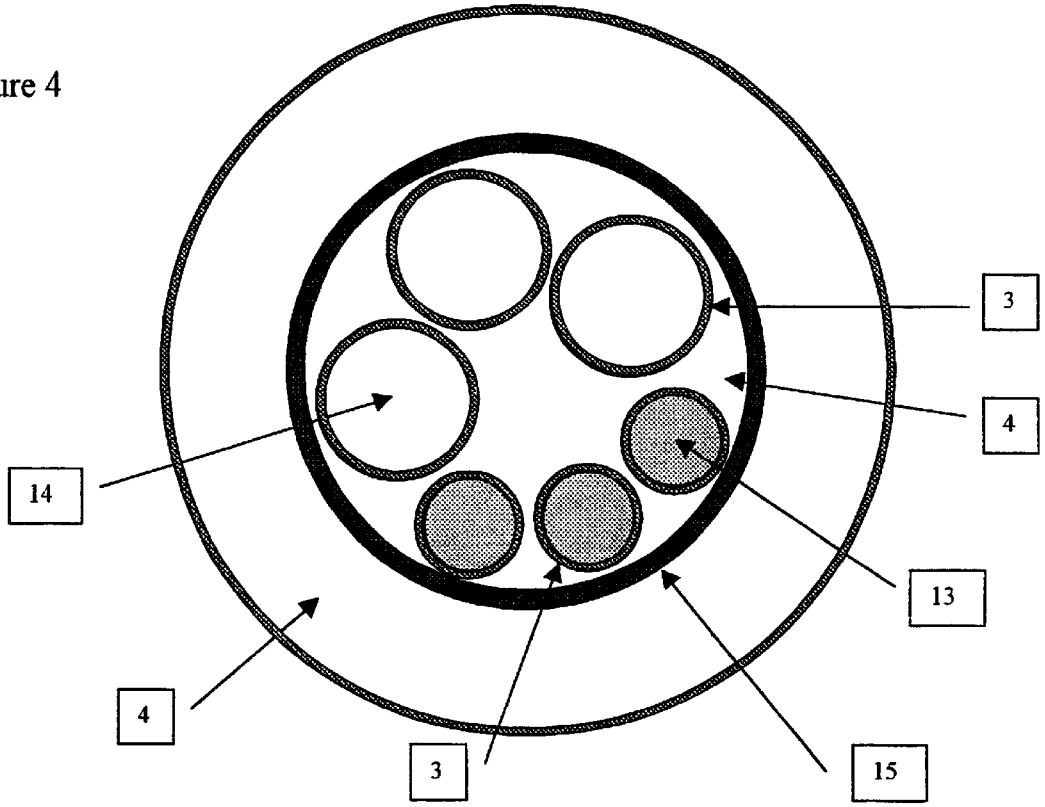
FIG. 4 is a cross-sectional end view of a signal carrying cable that is constructed in accordance with the present invention utilizing Litz style cores where the shaded cores are signal cores, and non-shaded cores are return cores.

Referring to FIG. 4, which comprises Litz style cores in both signal and return, the parts shown are signal conductive cores 13 (shaded), return conductive cores 14 (non-shaded) and inner insulation or shield (braid/foil) 15.

Return cores 14 have a greater total cross-sectional area than signal cores 13 based on the preferred cross-sectional area ratio of 1:2.778. Each individual return conductive core has a greater diameter or perimeter than each individual signal conductive core based on the preferred diameter or perimeter ratio of 1:1.667.

FIG. 4 is also an example of how shielding can be incorporated into a cable using the ratio.

Figure 5:
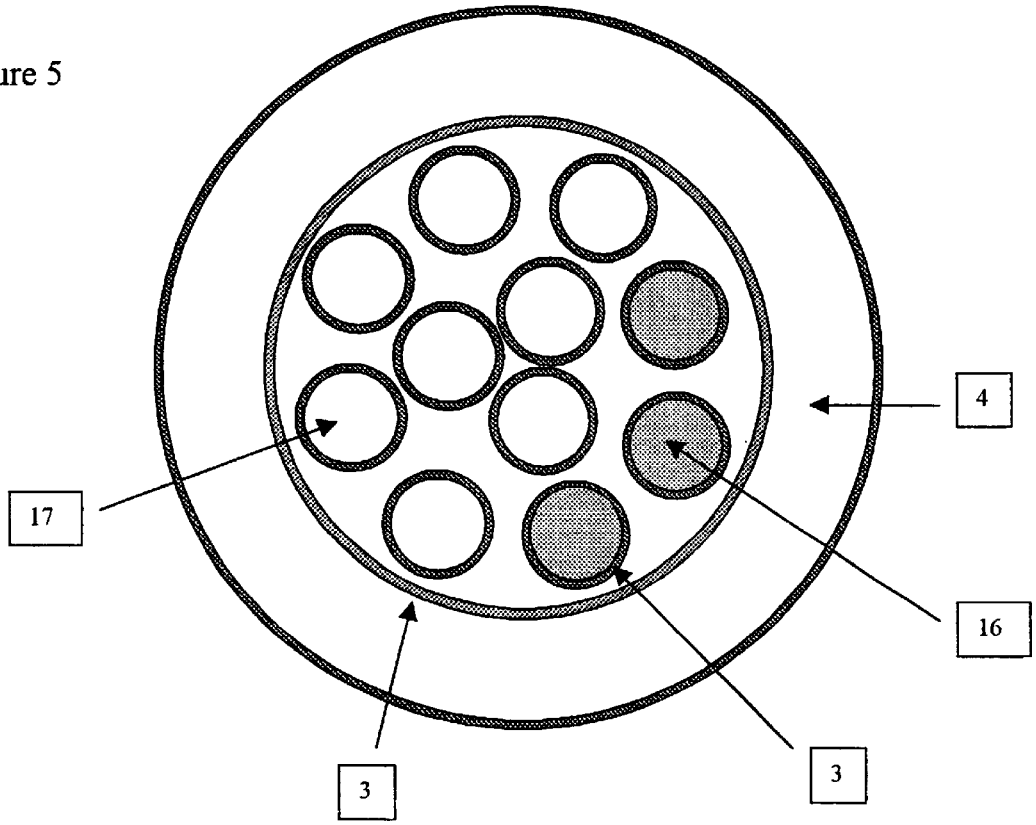
FIG. 5 is a cross-sectional end view of a signal carrying cable that is constructed in accordance with the present invention utilizing Litz style cores where each core is of the same diameter or perimeter, and where the shaded cores are signal cores, and non-shaded cores are return cores.

Referring to FIG. 5, which comprises Litz style cores wherein the diameter or perimeter of each individual core in the signal and return is the same. The parts shown are signal cores 16 (shaded), and return cores 17 (non-shaded).

When the diameter of each individual core in the signal and return cores has the same diameter or perimeter, then the total cross-sectional area of return cores 17 is greater than the total cross-sectional area of signal cores 16 based on the preferred cross-sectional area ratio of 1:2.778.

Figure 6:
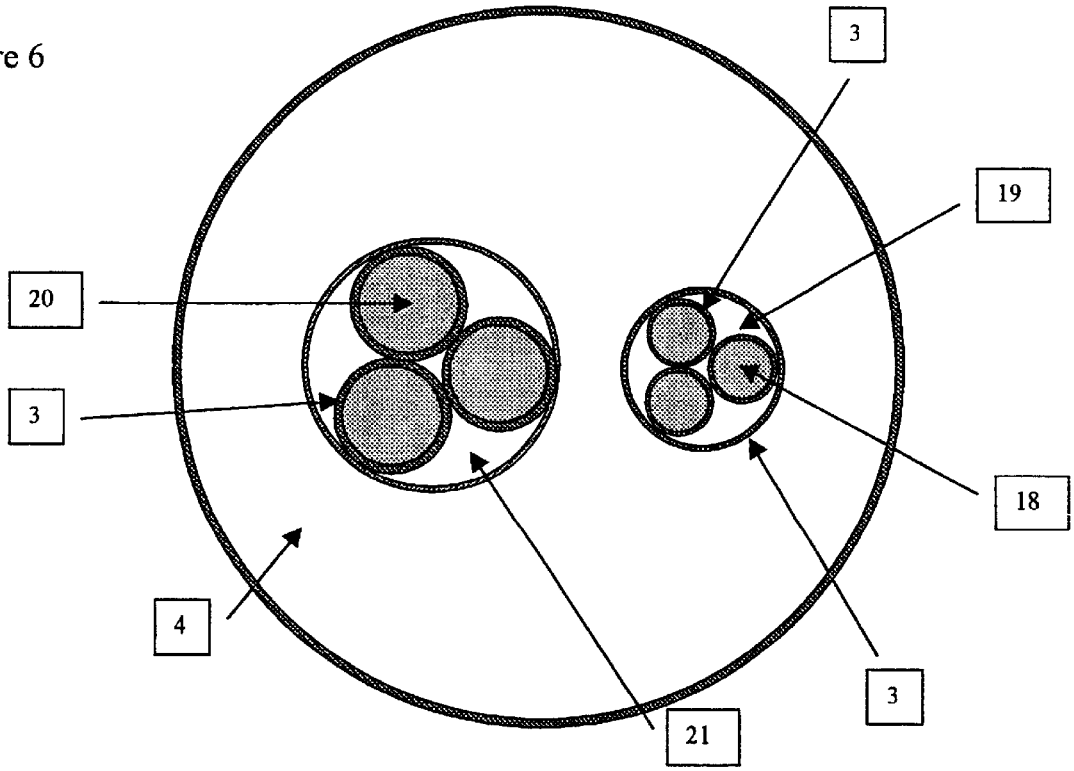
FIG. 6 is a cross-sectional end view of a signal carrying cable that is constructed in accordance with the present invention utilizing Litz style cores for both signal and return cores.

Referring to FIG. 6, which comprises Litz style conductors in both signal and return cores, the parts shown are signal conductive strands 18, signal core 19, return conductive strands 20 and return core 21.

Return core 21 has a greater cross-sectional area than signal core 19 based on the preferred cross-sectional area ratio of 1:2.778. Each individual return conductive strand 20 has a greater diameter or perimeter than each individual signal conductive strand 18 based on the preferred diameter or perimeter ratio of 1:1.667.

Figure 7:
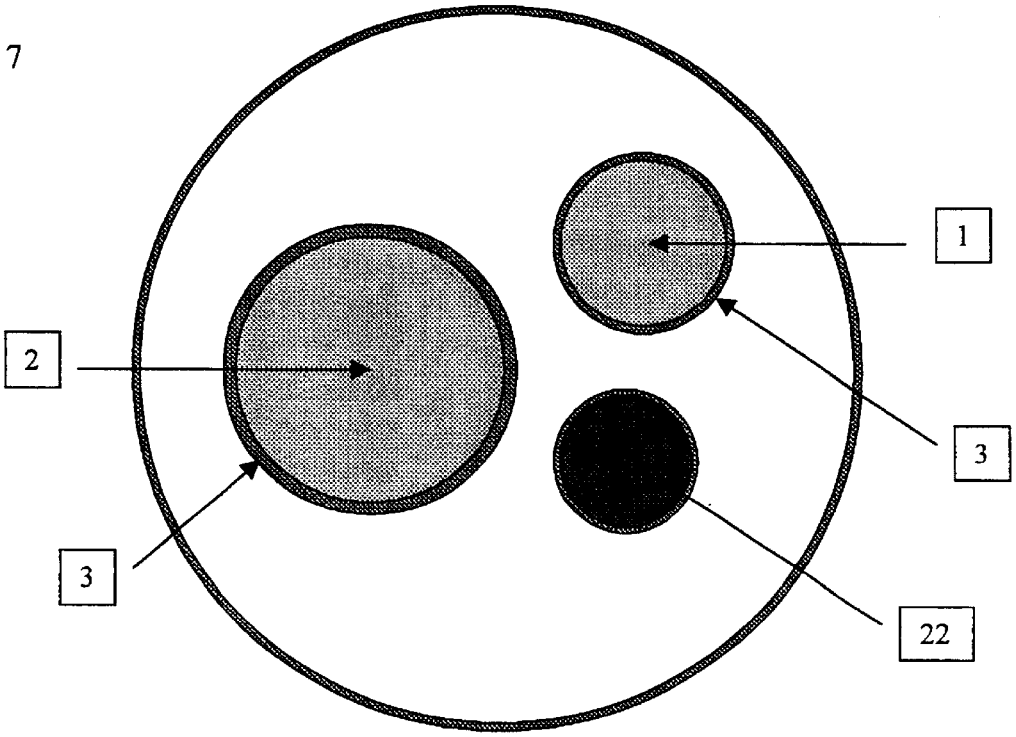
FIG. 7 is a cross-sectional end view of a balanced signal carrying cable that is constructed in accordance with the present invention utilizing one solid core for both the signal and return conductors, together with a ground core (either multi-strand or solid core).

Referring to FIG. 7, which comprises one, solid core for both the signal and return conductors plus one independent solid core or multi-strand core as ground for use in creating a balanced cable connected to XLR plugs. The parts shown are signal conductor 1, return conductor 2 and ground 22.

Return core 2 has a greater cross-sectional area, diameter or perimeter and hence mass than signal core 1 based on the preferred cross-sectional area ratio of 1:2.778 and preferred diameter or perimeter ratio of 1:1.667. Ground core 22 can be either a solid core or multi-strand core of any diameter or perimeter, and is not involved in the calculation of the ratio.

Figure 8:
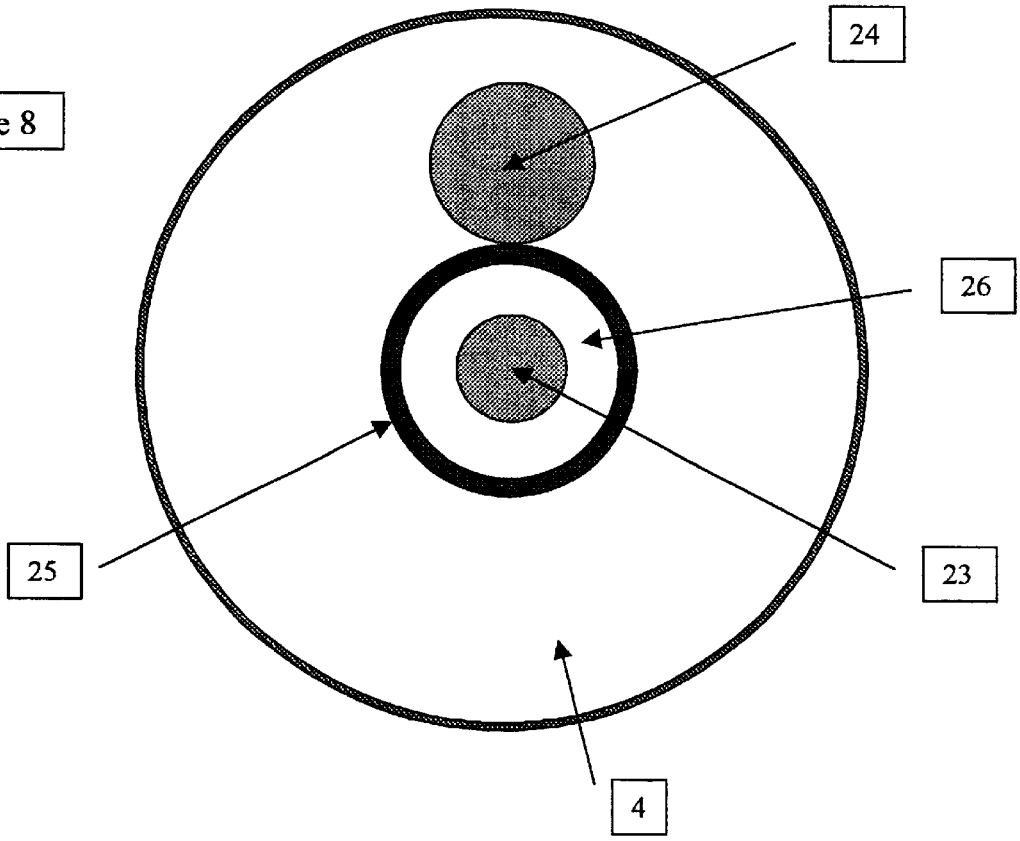
FIG. 8 is a is a cross-sectional end view of a signal carrying cable that is constructed in accordance with the present invention in a coaxial or shielded configuration using one solid core conductor for both signal and return.

Referring to FIG. 8, which comprises one solid core for both the signal and return conductors, where the signal core is surrounded by a coaxial type shield. Parts shown are signal core 23, return core 24, coaxial shield 25 and dielectric insulation material 26.

Return core 24 has a greater cross-sectional area, diameter or perimeter and hence mass than signal core 23 based on the preferred cross-sectional area ratio of 1:3.56 and preferred diameter or perimeter ratio of 1:1.887.

Coaxial shield 25 can be designed to provide specific impedance matching i.e. 75 Ohm or 110 Ohm to suit video or digital cables. Return core 24 may or may not be connected to the coaxial shield at either end or continuously along its length.

Figure 9:
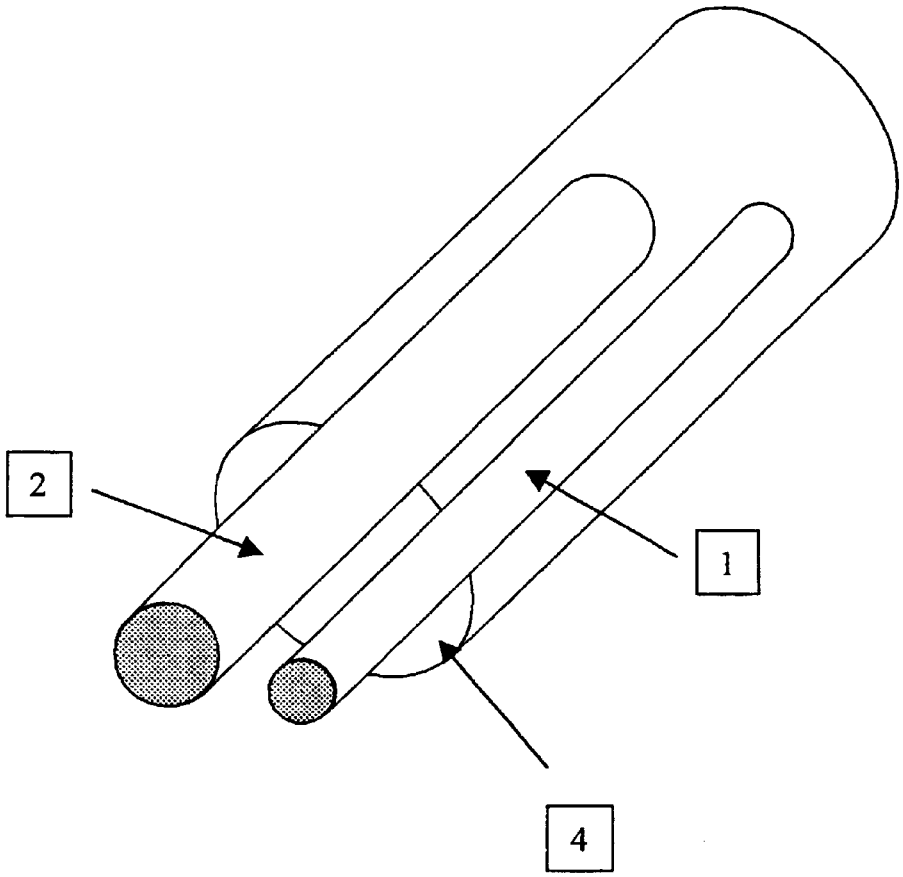
FIG. 9 is an isometric view of a signal carrying cable that is constructed in accordance with the present invention showing the signal and return cores laid in a parallel configuration.

Referring to FIG. 9, which comprises an isometric view of an audio cable showing the signal and return cores lying parallel to each other, and kept in a parallel position by means of a filler material. The parts shown are signal conductor 1, return conductor 2 and filler material 4.

Positioning the conductors in a parallel configuration helps minimize inductance and is the preferred means of cable construction when using the ratio.

It will of course be realized that the above has been given only by way of illustrative example of the present invention and that all such modifications and variations thereto as would be apparent to persons skilled in the art are deemed to fall within the broad scope and ambit of this invention as is herein before defined in claims.

What is claimed is:

1. A signal carrying cable comprising solid cores, multi-strand cores or Litz style cores of electrically conductive material such that the ratio of the cross sectional area of signal core in relation to return core is between 1:2.6 and 1:4.0 and the ratio of the diameter or perimeter of each strand is between 1:1.6 and 1:2.0.

2. The cable of claim 1 wherein the cross sectional area of each core and the diameter or perimeter of each strand of electrically conductive material is dependent on the effective current carrying capacity required.

3. A signal carrying cable comprising multi-strand or Litz style cores of electrically conductive material such that the diameter or perimeter of each individual solid strand is the same in both signal and return cores and the ratio of the cross sectional area of the signal core in relation to the return core is between 1:2.6 and 1:4.0.

4. The cable of claim 3 wherein the cross sectional area of each core and the diameter or perimeter of each strand of electrically conductive material is dependent on the effective current carrying capacity required.

* * * * *